US006623299B1

(12) United States Patent
Liu

(10) Patent No.: US 6,623,299 B1
(45) Date of Patent: Sep. 23, 2003

(54) CABLE END CONNECTOR ASSEMBLY WITH RELIABLE CONNECTION BETWEEN CABLE AND COVER

(75) Inventor: Huang Hsin Liu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/313,142

(22) Filed: Dec. 6, 2002

(30) Foreign Application Priority Data

Nov. 15, 2002 (TW) ..... 91218336

(51) Int. Cl.[7] ..... H01R 13/40
(52) U.S. Cl. ..... 439/604; 439/587; 439/660
(58) Field of Search ..... 439/604, 587, 439/274, 275, 588, 267, 660

(56) References Cited

U.S. PATENT DOCUMENTS 4,094,564 A * 6/1978 Cacolici ..... 439/456
5,580,264 A * 12/1996 Aoyama et al. ..... 439/275
5,813,877 A * 9/1998 Nakamura ..... 439/267
6,325,670 B2 * 12/2001 Murayama ..... 439/587

* cited by examiner

*Primary Examiner*—Hien Vu
(74) *Attorney, Agent, or Firm*—Wei Te Chung

(57) ABSTRACT

A cable end connector assembly (1) includes a dielectric housing (11), a plurality of contacts (12) received in the housing, a cable, and a cover. Each contact comprises a mating portion (120) and a tail portion (122) opposite to the mating portion. The cable comprises a plurality of conductive cores (21) enclosed by an outer insulating jacket (22). The conductive cores are partly exposed beyond the outer insulating jacket and are soldered with the tail portions, respectively. A through hole (23) is on the outer insulating jacket and in a front end of the cable. The cover is overmolded with a rear end of the electrical connector and the front end of the cable. A block (34) is on an inner surface of the cover and engages with the first engaging portion of the cable for enhancing a retaining force between the cover and the cable.

8 Claims, 5 Drawing Sheets

CABLE END CONNECTOR ASSEMBLY WITH RELIABLE CONNECTION BETWEEN CABLE AND COVER

CROSS-REFERENCE TO RELATED APPLICATION

This patent application is related to a co-pending application of U.S. patent application Ser. No. 10/313,144 filed on Dec. 6, 2002 and titled "CABLE END CONNECTOR ASSEMBLY WITH RELIABLE CONNECTION BETWEEN COVER AND HOUSING" invented by Huang-Hsin Liu, and assigned to the same assignee as this patent application.

BACKGROUND OF THE INVENTION

1. Field of the Invention

The present invention generally relates to a cable end connector assembly, and more particularly to a Serial ATA cable end connector assembly with reliable engaging connection between a cable and a cover.

2. Description of Related Art

There exists in the art an electrical connector assembly known as a Serial Advanced Technology Attachment (Serial ATA) cable end connector assembly which is generally used for transmitting high-speed signals between disk drives and a mother board. Because of many advantages superior to Parallel ATA, Serial ATA has a possibility of replacing Parallel ATA and becomes the next transmitting generation.

Please refer to FIG. 5, a Serial ATA cable end connector assembly 2 generally mates with a complementary electrical connector mounted on an edge of a mother board, and comprises a cable end connector 50, a cable 60, and a cover 70 over-molded with a rear end of the connector 50 and a front end of the cable 60. The cable end connector 50 comprises a dielectric housing 51, a plurality of contacts 52 assembled in the dielectric housing 51 with tail portions exposed beyond a rear face of the dielectric housing 51. The cable 60 comprises a plurality of conductive wires 61 electrically connecting the tail portions of the contacts 52 and an outer insulating jacket 62 enclosing the conductive wires 61. The cover 70 protects the electrical connection between the contacts 52 and the conductive wires 61, and forms a strain relief when the assembly 2 is separated from the complementary electrical connector. However, with the developing trend of integration and miniature of the mother board, electrical components and connectors mounted on the edge of the mother board are usually arranged side by side and the interval therebetween is very small. Thus, the cable 60 is often pulled for separating the cable end connector assembly 2 from the complementary electrical connector. In addition, the cover 70 engages with the cable 60 and the housing 51 only by friction. In fact, the pull force acting on the cable is larger than the friction force between the cover and the cable. Therefore, the conductive wires 61 and the contacts 52 must bear part of the pull force, and this disbennifits the electrical connection between the conductive wires 61 and the contacts 52 and influences the reliability of signal transmission inevitably.

Hence, a cable end connector assembly with reliably engaged cable and a cover is required to overcome the disadvantages of the related art.

SUMMARY OF THE INVENTION

An object of the present invention is to provide a cable end connector assembly, which has a reliable engaging connection between a cable and a cover thereof.

In order to achieve the objects set forth, a cable end connector assembly in accordance with the present invention comprises a dielectric housing, a plurality of contacts, a cable and a cover. A plurality of passageways is defined in the housing. Each contact is received in corresponding passageway, and comprises a mating portion and a tail portion opposite to the mating portion. The cable comprises a plurality of conductive cores enclosed by an outer insulating jacket. The conductive cores are partly exposed beyond the outer insulating jacket and electrically connect with the contacts. A first engaging portion is on the outer insulating jacket and in a front end of the cable. The cover is over-molded with a rear end of the electrical connector and the front end of the cable for protecting the electrical connection between the conductive cores and the contacts. A second engaging portion is on an inner surface of the cover and engages with the first engaging portion of the cable for enhancing a retaining force between the cover and the cable.

Other objects, advantages and novel features of the invention will become more apparent from the following detailed description when taken in conjunction with the accompanying drawings.

DETAILED DESCRIPTION OF THE INVENTION

Referring to FIGS. 1 to 4, a cable end connector assembly 1 in accordance with the present invention comprises an electrical connector 10, a cable 20 electrically connecting with the electrical connector 10, and a cover 30 over-molded with a rear end of the electrical connector 10 and a front end of the cable 20. In the preferred embodiment of the present invention, the cable end connector assembly 1 is in the form of a Serial ATA cable end connector assembly.

Figure 1:
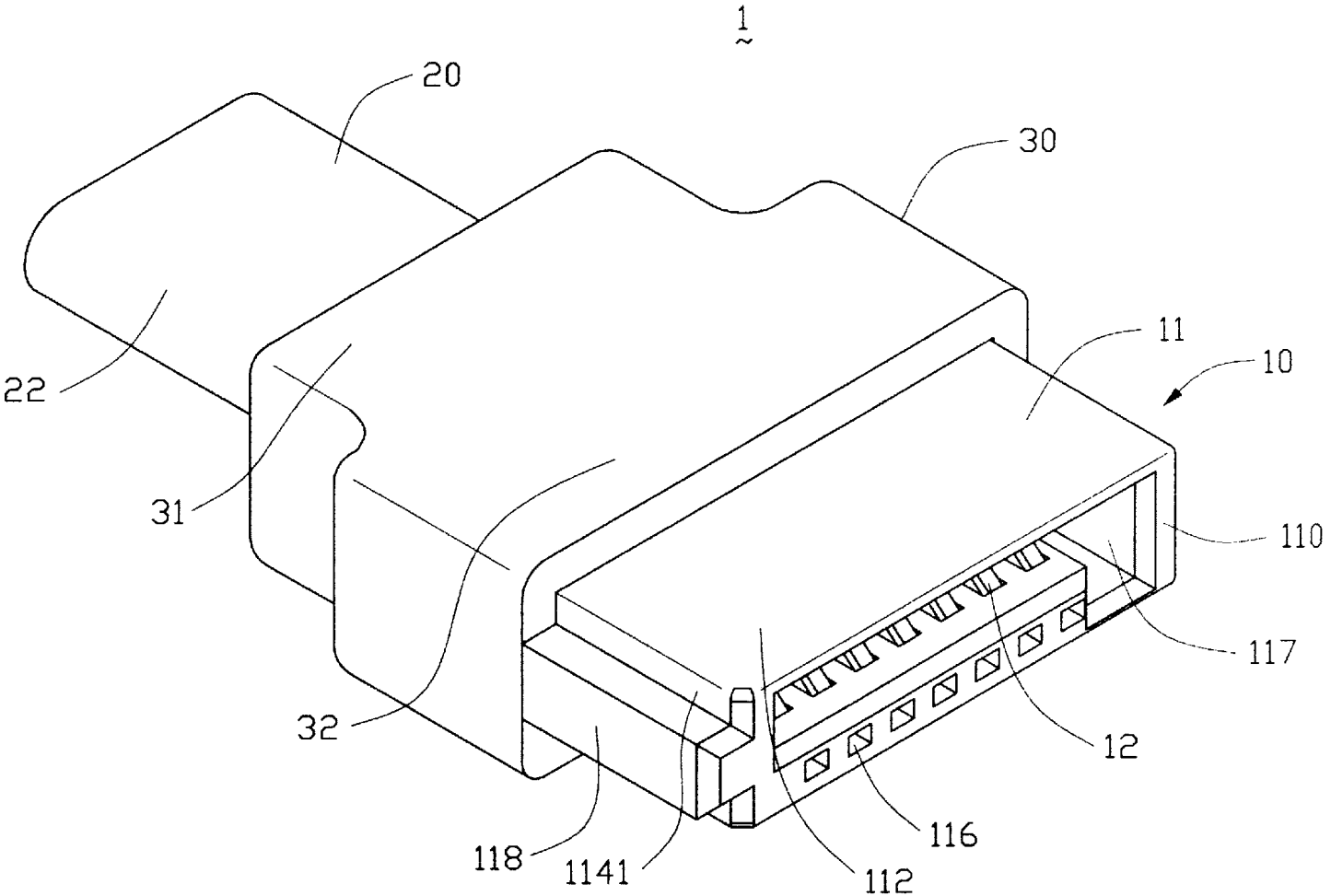
FIG. 1 is an assembled view of a cable end connector assembly in accordance with the present invention.
Figure 2:
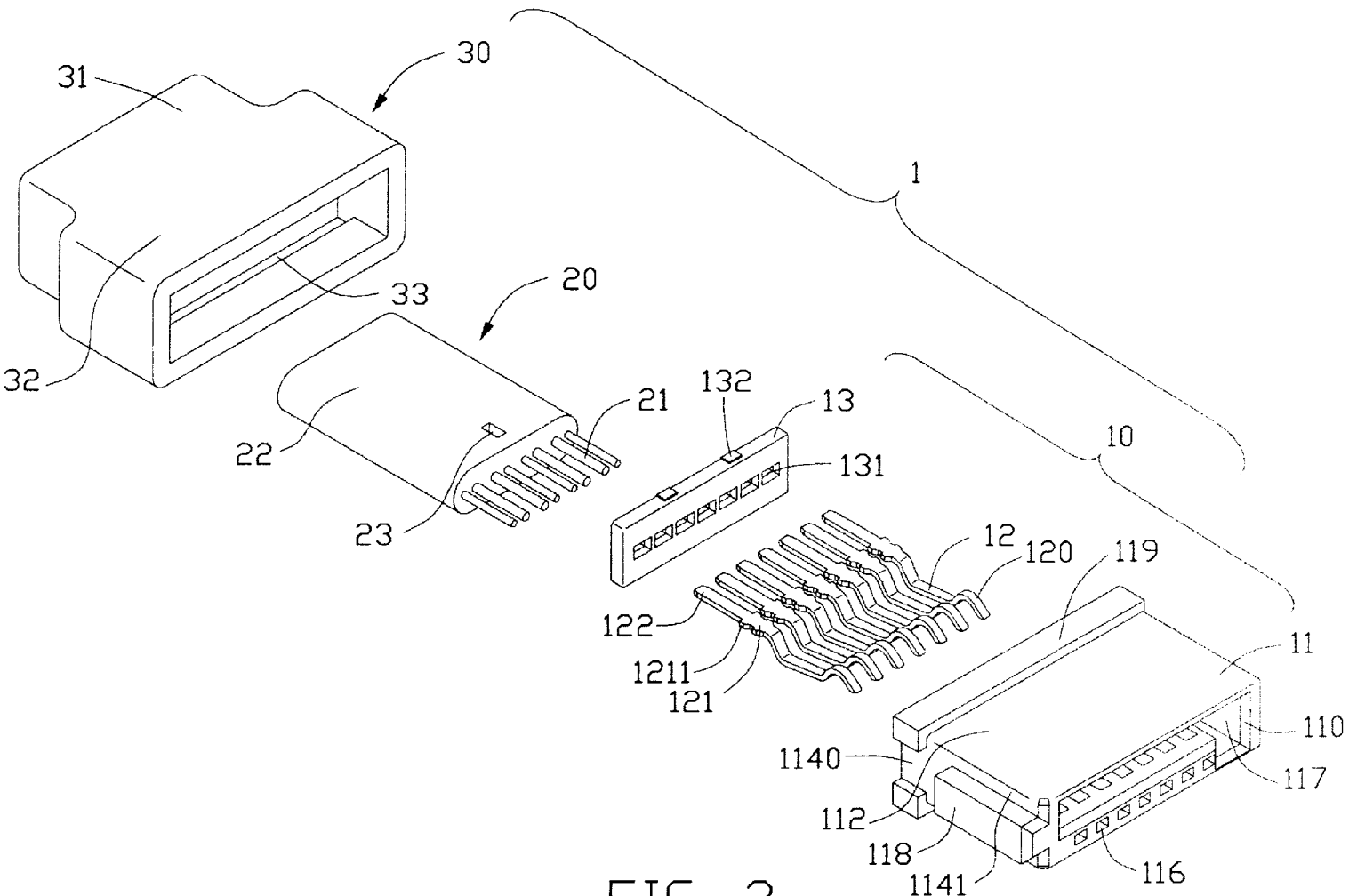
FIG. 2 an exploded, perspective view of the cable end connector assembly shown in FIG. 1.
Figure 3:
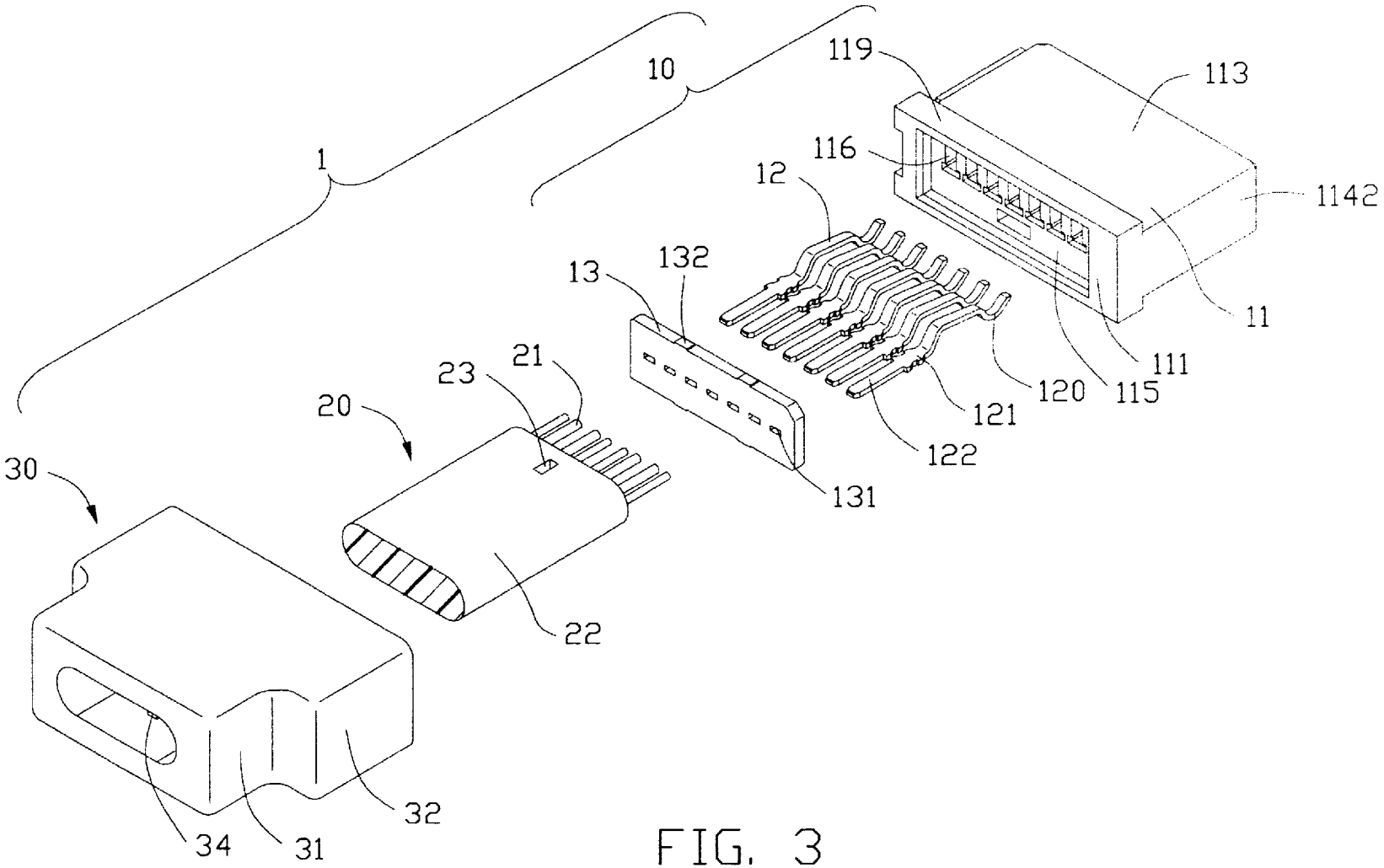
FIG. 3 is a view similar to FIG. 2, but taken from rear and bottom aspects.

Referring to FIGS. 2 and 3, the electrical connector 10 comprises a dielectric housing 11, a plurality of contacts 12, and a spacer 13. The dielectric housing 11 is in the shape of a rectangular block and comprises a mating face 110, a rear face 111 opposite to the mating face 110. The dielectric housing 10 comprises an upper wall 112, a lower wall 113 opposite to the upper wall 112, and a pair of opposite sidewalls 1141, 1142 connecting the upper and lower walls 112, 113. The upper and lower walls 112, 113, and the opposite sidewalls 1141, 1142 together define an L-shaped receiving space 117 for receiving a mating portion of a complementary electrical connector. A plurality of passageways 116 is defined through the lower wall 113 in a front-to-rear direction of the housing 11. A guiding projection 118 protrudes sidewardly from an outer surface of the sidewall 1141 for engaging with the complementary electrical connector. A pair of retaining portions 119 is formed on the upper and lower walls 112, 113, respectively and adjacent to the rear face 111 of the housing 11. Each retaining portion 119 extends beyond the outer surface of the sidewall 1141 and toward a middle of the sidewall 1141 to form a pair of protrusions. The protrusions, the guiding projection 118, and the sidewall 1141 together define a channel 1140 for receiving melted plastic material of the cover 30. A receiving slot 115 is defined in a rear end of the housing 11 from the rear face 111 and communicates with the passageways 116.

Each contact 12 comprises a retention portion 121, a mating portion 120 extending forwardly from the retention portion 121, and a tail portion 122 extending rearwardly from the retention portion 121. Each retention portion 121 forms a plurality of barbs 1211 on a pair of sides thereof.

The spacer 13 is a rectangular board and defines a plurality of holes 131 corresponding to the tail portions 122 of the contacts 12. An upper edge and a lower edge of the spacer 13 each forms a pair of tubers 132 for engaging with inner surfaces of the receiving slot 115 of the housing 11.

The cable 20 comprises a plurality of signal and grounding conductive wires 21 enclosed by an outer insulating jacket 22. The conductive wires 21 are partly exposed beyond the outer insulating jacket 22 for electrically connecting with the contacts 12 of the electrical connector 10. A through hole 23 is defined through the outer insulating jacket 22 of the cable 20 from an upper outer surface to a lower outer surface of the insulating jacket 22. The through hole 23 is in a middle of the front end of the cable 20 and between two grounding conductive wires 21 locating in the middle of the cable 20.

The cover 30 is preferably comprised of molded plastic or polymer materials and comprises a front receiving portion 32 for receiving the rear end of the housing 11, and a cable receiving portion 31 for receiving the front end of the cable 20. A pair of slots 33 is defined in an upper inner wall and a lower inner wall of the front receiving portion 32, respectively for receiving the retaining portions 119 and the protrusions therein.

Figure 4:
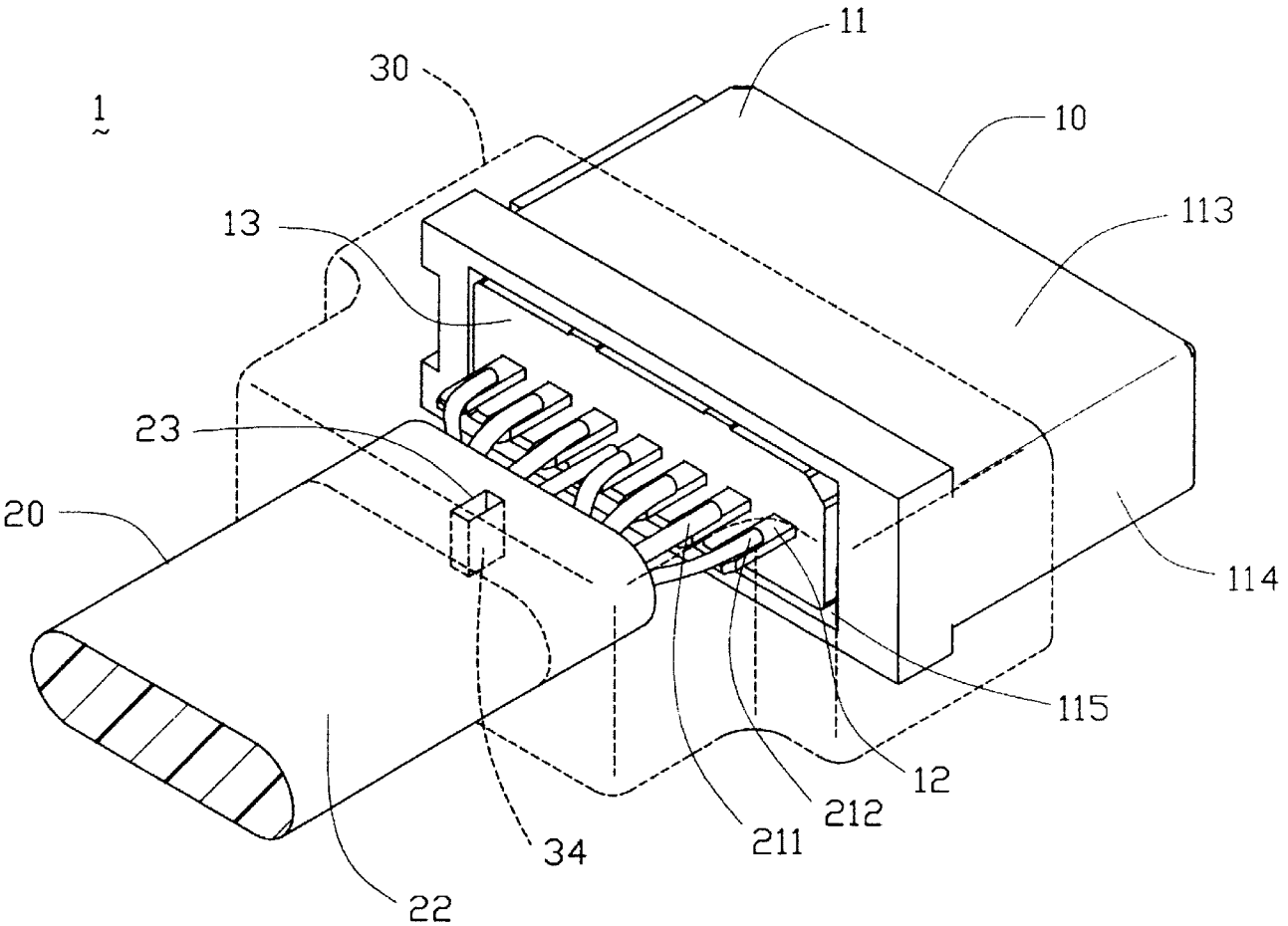
FIG. 4 is an assembled view of FIG. 3, with a cover in a perspective view.
Figure 5:
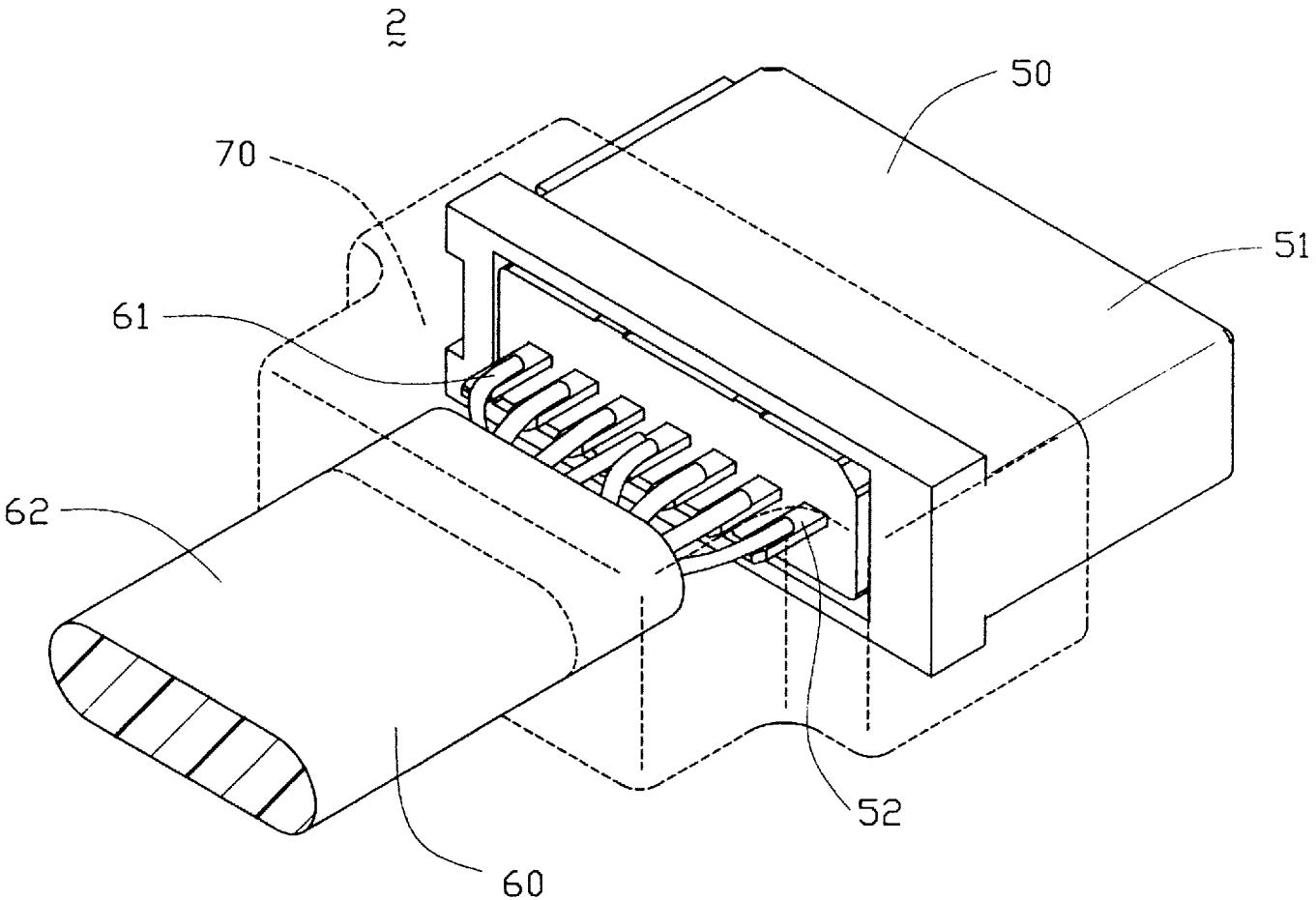
FIG. 5 (PRIOR ART)
FIG. 5 is an assembled view of a conventional cable end connector assembly, with a cover in a perspective view.

In assembly, referring to FIGS. 2 to 4, the contacts 12 of the electrical connector 10 are first inserted into the dielectric housing 11 in a rear-to-front direction. Each mating portion 120 of the contact 12 protrudes through and is received in corresponding passageway 116 and is partly exposed in the receiving space 17 for electrically connecting the complementary electrical connector. Each retention portion 121 of the contact 12 is received in corresponding passageway 116 and the barbs 1211 thereof engage with opposite inner surfaces of the passageway 116. The tail portion 122 of each contact 12 is exposed beyond the rear face 111 of the housing 11 for being soldered with the cable 20. Then, the spacer 13 is pushed and received into the receiving slot 115 with the tubers 132 engaging with the inner surfaces of the receiving slot 115. The tail portions 122 protrude through the holes 131 of the spacer 13, respectively. The spacer 13 seals the rear end of the housing 11 and efficiently prevents the melted plastic material of the cover 30 from entering into the housing 11 and causing influence to the electrical connection between the cable end connector assembly 1 and the complementary electrical connector.

The conductive cores 21 of the cable 20 are then soldered with the tail portions 122 of the contacts 12, respectively. Thus, the electrical connector 10 electrically connects with the cable 20. The cover 30 is over-molded with the rear end of the electrical connector 10 and the front end of the cable 20. The rear end of the housing 11 and the front end of the cable 20 are received in the front receiving portion 32, the slots 33, and the cable receiving portion 31, respectively. The retaining portions 119 and the protrusions formed on the sidewall 1141 are received in the slots 33 engaging with the inner walls of the front receiving portion 32 of the cover 30 for providing a retaining force between the electrical connector 10 and the cover 30. A lateral wall of the cover 30 is received in the channel 1140 of the housing 11 when the lateral wall in solid state, and an outer surface thereof is coplanar with an outer surface of the guiding projection 118. The melted material of the cover 30 flows through the through hole 23 defined in the middle of the front end of the cable 20; thus, a strengthened block 34 is formed in inner surfaces of the cable receiving portion 31. The block 34 furthest increases the retaining force between the cable 20 and the cover 30, and the electrical connection between the electrical connector 10 and the cable 20 is more reliably. The cover 30 forms a strain relief between the electrical connector 10 and the cable 20 when the cable end connector assembly 1 is separated from the complementary electrical connector. The cover 30 also protects the electrical connection between the contacts 12 and the conductive cores 21 of the cable 20. Therefore, the cable end connector assembly 1 in accordance with the present invention achieves the goal of assuring the reliable engagement between the cable 20 and the cover 30, and the reliability of signal transmission.

In alternative embodiments, the through hole 23 defined through the outer insulating jacket 22 of the cable 20 can be a recess defined in the outer insulating jacket 22, and the block 34 of the cover 30 is received in the recess. The through hole 23 also can be a plurality of projections formed on the outer insulating jacket 22, and the block 34 can be a plurality of recesses defined in cable receiving portion 31. The projections are received in the recesses, respectively.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly, comprising:

a dielectric housing defining a plurality of passageways therein;

a plurality of contacts received in the passageways respectively, each contact comprising a mating portion and a tail portion opposite to the mating portion;

a cable comprising a plurality of conductive cores directly enclosed by an outer insulating jacket, the conductive cores partly exposed beyond the outer insulating jacket and electrically connecting with the contacts, a first engaging portion on the outer insulating jacket and in a front end of the cable; and a cover over-molded with a rear end of the electrical connector and the front end of the cable for protecting the electrical connection between the conductive cores and the contacts, a second engaging portion on an inner surface of the cover and engaging with the first engaging portion of the cable so as for enhancing a retaining force between the cover and the cable; wherein the first engaging portion is a through hole defined through the outer insulating jacket and in a middle of the front end of the cable, and the second engaging portion is a block formed on tie inner surface of the cover and received in the through hole; wherein the dielectric housing comprises an upper wall, a lower wall opposite to the upper wall, and a pair of sidewalls, the passageways are defined through the lower wall of the housing; wherein the upper and lower walls, and the opposite sidewalls together define an L-shaped receiving space adapted for receiving a mating portion of a complementary electrical connector therein, the mating portion of each contact is received in the passageway and is partly exposed in the receiving space, further comprising a spacer received in the rear end of the dielectric housing and sealing the rear end of the housing for preventing the melted material of the cover from entering into the housing.

2. The cable end connector assembly as claimed in claim 1, wherein each contact further comprises a retention portion connecting the mating portion and the tail portion, a plurality of barbs is formed on a pair of sides of the retention portion and engages with inner opposite surfaces of corresponding passageway.

3. The cable end connector assembly as claimed in claim 1, the spacer defines a plurality of holes, the tail portions of the contacts protrude through the holes respectively, and are soldered with the conductive cores of the cable, respectively.

4. The cable end connector assembly as claimed in claim 3, wherein the housing defines a receiving slot in the rear end thereof, and the spacer is received in the receiving slot.

5. The cable end connector assembly as claimed in claim 1, wherein the cover comprises a front receiving portion receiving the rear end of the housing, and a cable receiving portion receiving the front end of the cable.

6. The cable end connector assembly as claimed in claim 5, wherein a pair of slots is defined in an upper and a lower inner walls of the front receiving portion respectively, a pair of retaining portions is formed on the upper and lower walls of the housing adjacent to a rear face of the housing and received in the slots, respectively for providing a retaining force between the housing and the cover.

7. The cable end connector assembly as claimed in claim 1, wherein a guiding projection protrudes sidewardly from an outer surface of one sidewall of the housing adapted for engaging with the complementary electrical connector.

8. The cable end connector assembly as claimed in claim 1, wherein the cable end connector assembly is a Serial Advanced Technology Attachment (Serial ATA) cable end connector assembly.

* * * * *